US005438384A

United States Patent [19]

Earle

[11] Patent Number: 5,438,384

[45] Date of Patent: Aug. 1, 1995

[54] PHOTOGRAPHIC APPARATUS

[75] Inventor: Anthony Earle, Harold Weald, England

[73] Assignee: Eastman Kodak Company, Rochester, N.Y.

[21] Appl. No.: 227,210

[22] Filed: Apr. 12, 1994

[30] Foreign Application Priority Data

Apr. 13, 1993 [GB] United Kingdom ..... 9307513

[51] Int. Cl.[6] ..... G03D 3/04

[52] U.S. Cl. ..... 354/329; 354/330; 354/339

[58] Field of Search ..... 354/324, 329, 330, 331, 354/336; 355/245, 256, 271; 118/688, 645, 637

[56] References Cited

U.S. PATENT DOCUMENTS

| | | | |
|---|---|---|---|
| 3,462,054 | 8/1969 | Foor | 226/91 |
| 3,559,558 | 2/1971 | Hamlin et al. | 354/329 |
| 4,180,317 | 12/1979 | Schroter | 354/318 |
| 4,622,916 | 11/1986 | Tanaka et al. | 118/688 |
| 5,064,738 | 11/1991 | Rakov et al. | 430/117 |
| 5,150,161 | 9/1992 | Bujese | 355/256 |
| 5,221,944 | 6/1993 | Yoda et al. | 355/256 |
| 5,245,388 | 9/1993 | Rydelek et al. | 355/245 |
| 5,291,251 | 3/1994 | Storlie et al. | 355/271 |

FOREIGN PATENT DOCUMENTS

| | | | |
|---|---|---|---|
| 0226213 | 6/1987 | European Pat. Off. . | |
| 506070 | 11/1921 | France | 354/339 |
| 2358291 | 6/1975 | Germany | 354/329 |
| 298965 | 7/1927 | United Kingdom . | |
| WO90/04809 | 5/1990 | WIPO . | |

*Primary Examiner*—D. Rutledge
*Attorney, Agent, or Firm*—Peter J. Bilinski

[57] ABSTRACT

In known photographic apparatus, processing is achieved by passing the material to be processed from one processing stage to the next in a predetermined sequence. This necessitates that the processing stages are sequentially arranged in the apparatus. However, if the material being processed requires more than one identical processing step, for example, two or more wash processes, the processing stages need to be duplicated. Described herein is apparatus in which the processing stages need not be duplicated and in which the stages may be arranged accordingly. The apparatus comprises a rotating drum 10,(110) on which the material (16) to be processed is mounted, and a multi-tank container 12,(112) housing a plurality of compartments (120, 122, 124, 126, 128), each compartment containing one of the desired processing solutions (130, 132, 134, 136, 138). Application rollers (140, 142, 144, 146, 148) are associated with respective ones of the compartments (120, 122, 124, 126, 128) for transferring the processing solutions contained therein on to the material (16) being processed. Each application roller (140, 142, 144, 146, 148) moves from a first position where no contact is made with the rotating drum to a second position where contact is made with the rotating drum (110) to effect the transfer of processing solution. Additionally, an exposing device (116) may be provided for forming an image on the material (16) to be processed prior to processing.

10 Claims, 4 Drawing Sheets

PHOTOGRAPHIC APPARATUS

FIELD OF THE INVENTION

The present invention relates to photographic apparatus and is more particularly, although not exclusively, concerned with photographic processing apparatus having low throughputs.

BACKGROUND OF THE INVENTION

In most known photographic processing apparatus, photographic material is passed through a series of baths containing processing solutions appropriate to that particular material. The material is driven sequentially through the baths by roller pairs.

In other processing apparatus, a plurality of rollers is used to pick up processing solutions from trays and transfer the solutions on to the material as it is passed across the top of the rollers.

In both cases, the material is free and it is effectively passed from solution to solution. For example, in a simple photographic process, developer, fixer and wash solutions have to be arranged in order so that the material can pass from one processing stage to the next in one pass.

However, in the processing apparatus described above, there is no flexibility as it is not possible to return to a processing stage already visited.

Furthermore, it is difficult to reduce the size of the processing apparatus when several identical processing stages are required.

SUMMARY OF THE INVENTION

It is therefore an object of the present invention to provide processing apparatus which is flexible in that the processing stages need not be sequentially arranged.

In accordance with one aspect of the present invention, there is provided photographic apparatus including at least a processing stage which comprises:

a rotating drum on which material to be processed is mounted;

a plurality of reservoirs each containing one processing solution; and applicator means for transferring processing solution from the plurality of reservoirs to the material being processed;

characterized in that the applicator means comprises a plurality of application rollers, each application roller being associated with a respective one of the reservoirs; and in that there is relative movement between each application roller and the rotating drum to effect transfer of the processing solution.

Relative movement between each application roller and the rotating drum may be achieved by movement of the rotating drum between a first position where there is no contact with the application rollers and a plurality of second positions where contact is made with respective ones of the application rollers.

Alternatively, each application roller may move between a first position where no contact is made with the rotating drum and a second position where contact is made with the rotating drum.

In one embodiment of the invention, the plurality of reservoirs is arranged side by side in an elongate tray which is mounted for reciprocating motion relative to the rotating drum. In this arrangement, the application rollers lie in a plane which extends parallel to the direction of reciprocating motion, and each roller moves from the first position to the second position in a direction which is substantially perpendicular to the plane in which they lie.

In a second embodiment of the invention, the plurality of reservoirs is arranged in a multi-tank container disposed around at least a portion of the rotating drum. In this case, the application rollers lie on the circumference of a circle having its center on the axis about which the rotating drum rotates, and each roller moves from the first position to the second position along a radius of the circle.

Additionally, an exposure device may be included for exposing an image on the material prior to application of the processing solutions.

ADVANTAGEOUS EFFECT OF THE INVENTION

The apparatus of the present invention has the advantage that the material being processed can be firmly held and processing solutions applied in any desired sequence regardless of the physical arrangement of the reservoirs for such solutions.

Furthermore, an image station can be provided in which an image is applied to material which is subsequently processed to produce a copy of the image.

BRIEF DESCRIPTION OF THE DRAWINGS

For a better understanding of the present invention, reference will now be made, by way of example only, to the accompanying drawings in which.

DETAILED DESCRIPTION OF THE INVENTION

The present invention will be described in relation to the processing of photographic paper, but any other photographic material can be processed in the same manner.

Furthermore, the present invention is not limited to use with photographic materials and is applicable to any process where chemically sensitive material needs to be treated.

Figure 1:
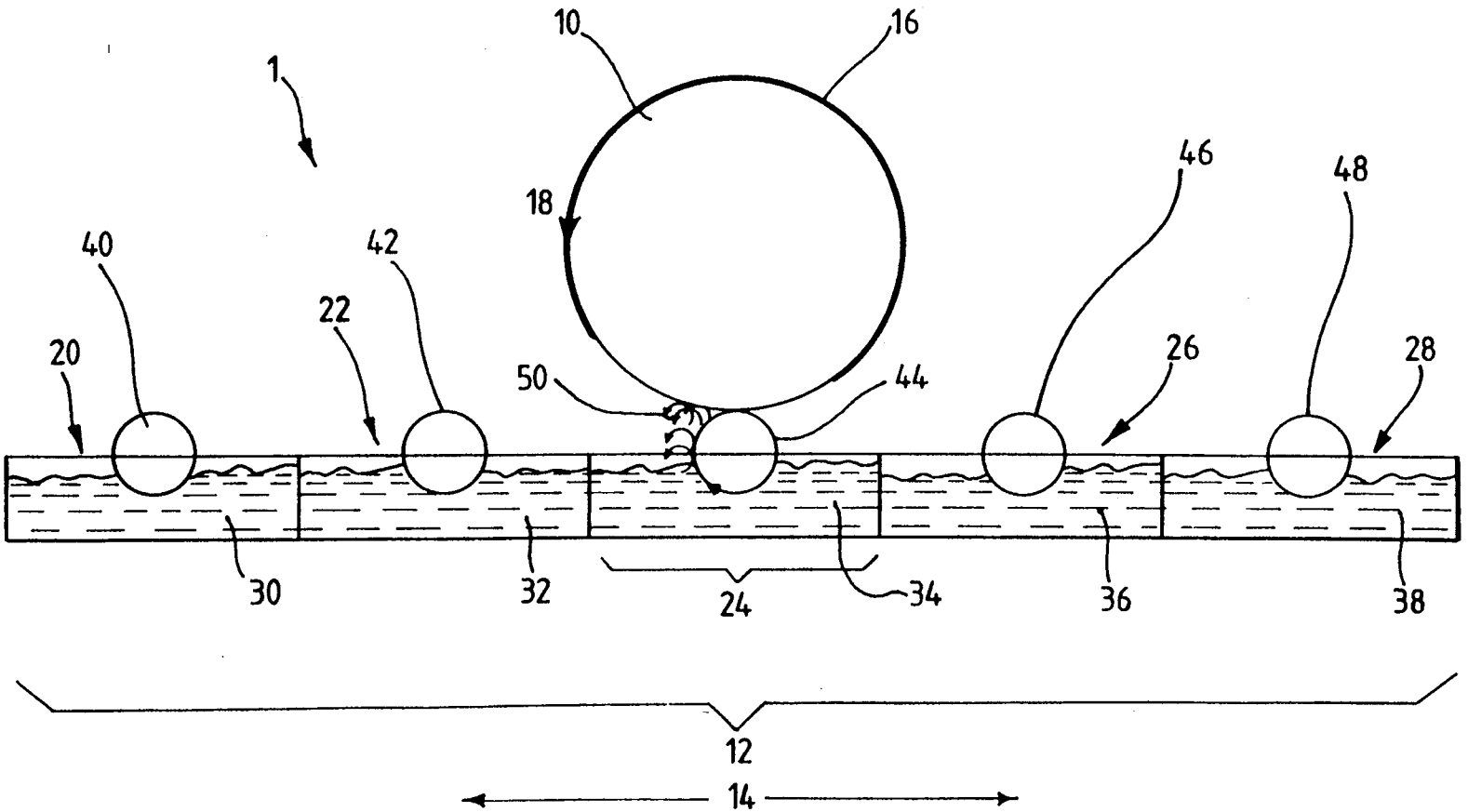
FIG. 1 is a schematic illustration of one embodiment of processing apparatus constructed in accordance with the present invention.

Referring initially to FIG. 1, a drum processor arrangement 1 is shown. The arrangement 1 comprises a processing drum 10 and a tray assembly 12. The tray assembly 12 comprises a plurality of processing solution trays 20, 22, 24, 26, 28, each containing processing solution 30, 32, 34, 36, 38 and having an applicator roller 40, 42, 44, 46, 48 associated therewith. The tray assembly 12 is arranged for reciprocating movement relative to the processing drum 10 as indicated by arrows 14.

In the arrangement shown in FIG. 1, the processing solutions are as follows:

solution 30 is developer;

solution 32 is bleach/fix; and solutions 34, 36, 38 are stabilizers

Material to be processed, indicated by numeral 16, is attached to the drum 10, by means not shown, for rotation therewith in the direction indicated by arrow 18.

As the tray assembly 12 is reciprocated in the directions shown by arrow 14, each applicator roller 40, 42, 44, 46, 48 is brought into contact with the material 16 to apply the appropriate processing solution thereto. As each roller 40, 42, 44, 46, 48 comes into contact with the drum 10, it is caused to rotate due to drive being transferred from the drum 10. Then as the roller rotates, it picks up processing solution in its associated tray and transfers it on to the surface of the material being processed. This is shown in more detail in FIG. 2.

Figure 2:
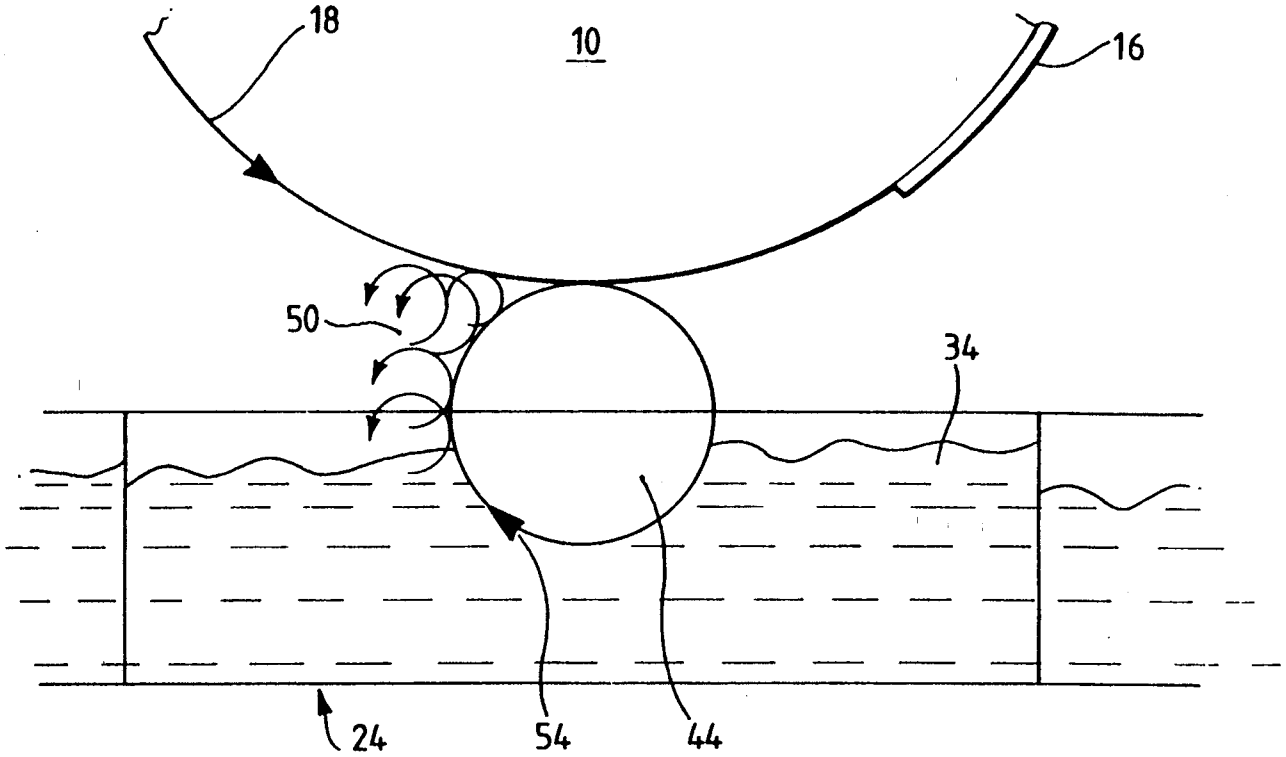
FIG. 2 is an enlarged fragmentary view of the apparatus shown in FIG. 1 illustrating the material-solution interface.

In FIG. 2, application roller 44 is shown in contact with the drum 10. As the drum 10 rotates in the direction of arrow 18, roller 44 is caused to rotate in the direction indicated by arrow 54 and picks up solution 34 from the tray 24 and then transfers the solution on to the surface of the paper 16 and the drum 10.

As roller 44 is arranged to provide a nip with the surface of drum 10, only solution which has been absorbed by the paper 16 is carried around as the drum rotates. Any solution not absorbed by the paper is forced off the surface of the drum. This forms a region 50 of high agitation as shown. As the drum 10 rotates, the paper passes through region 50 before it passes through the nip. This acts to refresh the solution applied to the paper.

Although each compartment 20, 22, 24, 26, 28 of the tray assembly 12 is arranged in so that each processing stage follows in order, the order can be rearranged and each processing solution accessed by reciprocating the tray 12 in the direction of arrow 14 as required.

Figure 3:
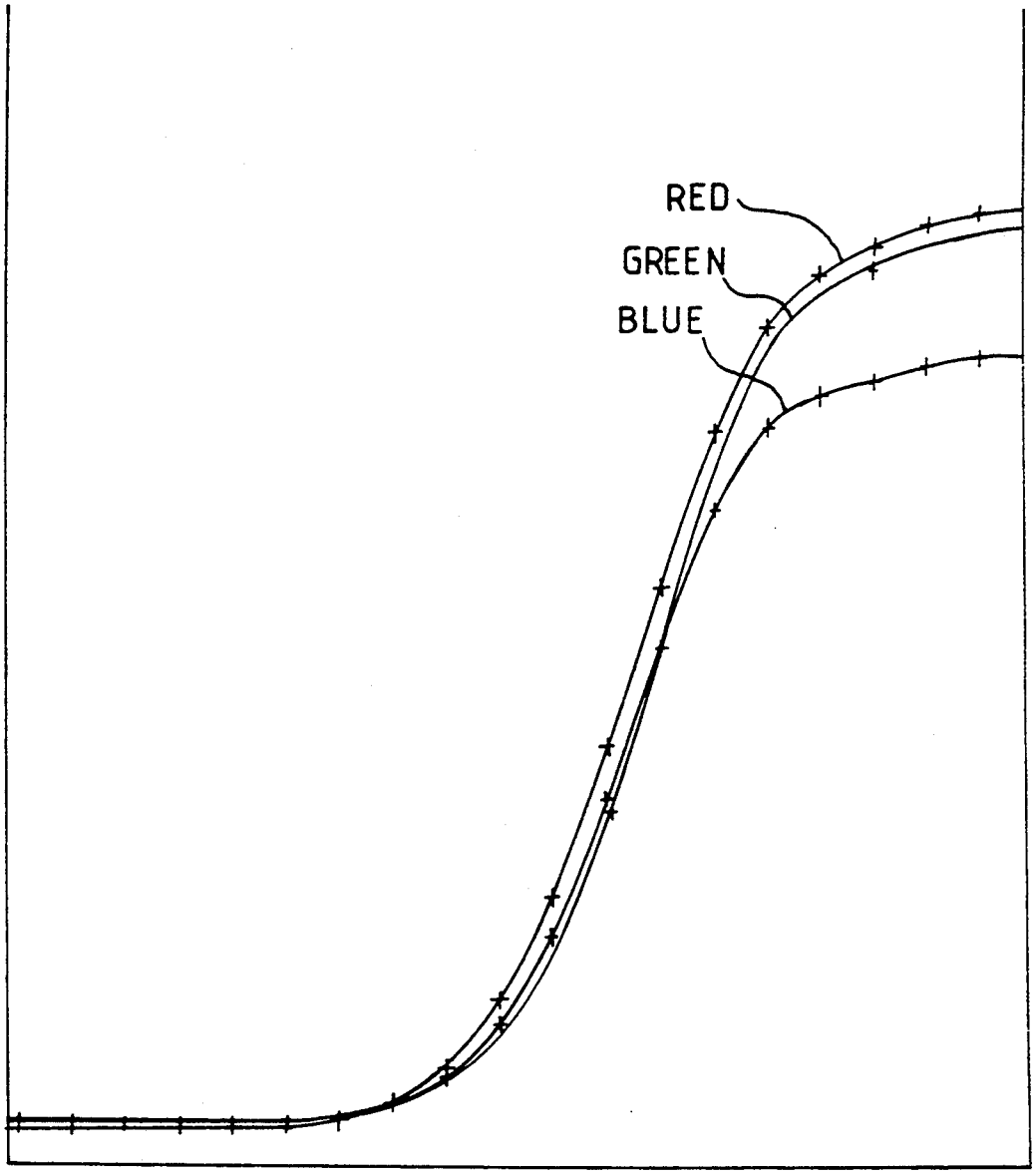
FIG. 3 is a sketch of a sensitometric curve obtained when processing material using apparatus according to the present invention.

FIG. 3 illustrates a typical sensitometric curve which was obtained using this apparatus. Ektacolor 2000 paper was processed at room temperature in RA4 chemistry. The development time was 6 min with 3 min of fixing and stabilizing.

Figure 4:
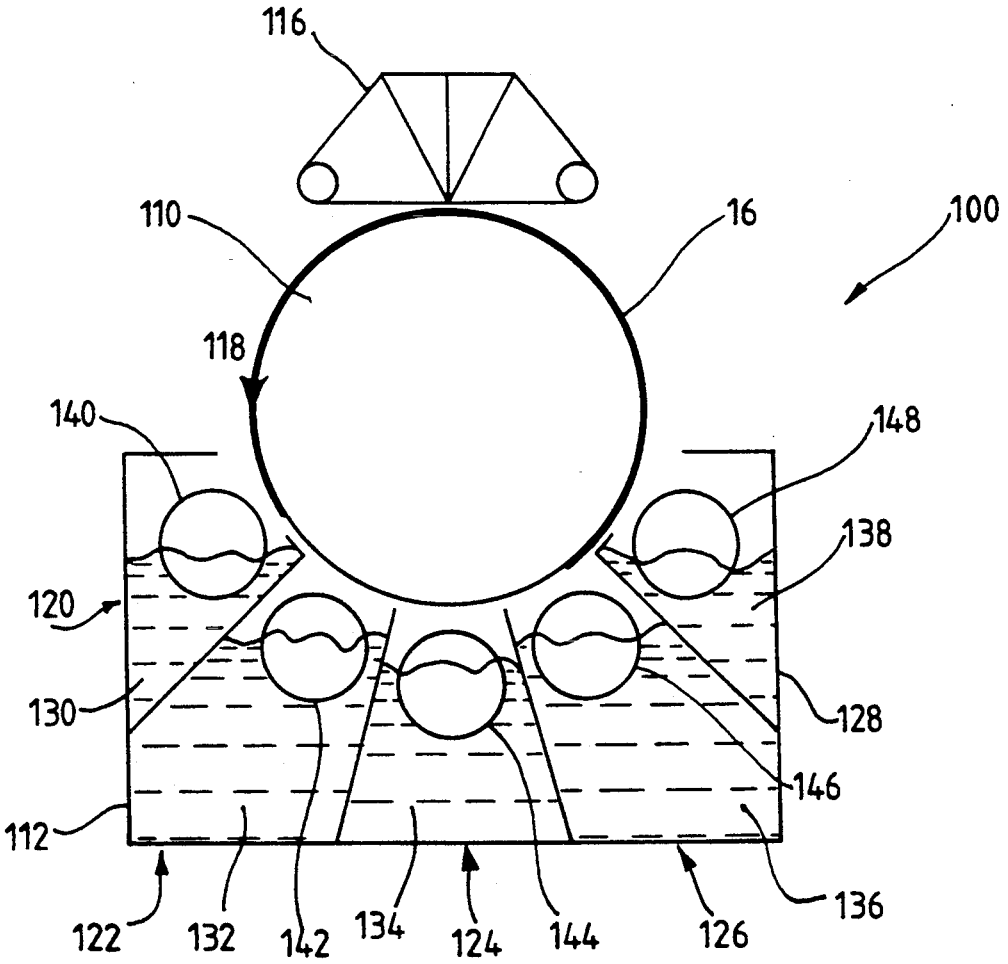
FIG. 4 is similar to FIG. 1, but illustrating another embodiment of processing apparatus constructed in accordance with the present invention.

FIG. 4 illustrates another embodiment of the present invention. As before, drum processor arrangement 100 comprises a processing drum 110 and a tray assembly 112. However, in this case, the tray assembly 112 is arranged to so that each compartment 120, 122, 124, 126, 128 is disposed around the periphery of the drum 110 and there is no need for reciprocatory motion of the tray assembly 112 relative to the drum 110. This provides a more compact, self-contained processing station as tray assembly 112 can be supplied as a single multi-tank container and disposed as such after use.

Each compartment 120, 122, 124, 126, 128 of the tray assembly 112 houses processing solutions 130, 132, 134, 136, 138 and respective associated application rollers 140, 142, 144, 146, 148 as described above. Each roller 140, 142, 144, 146, 148 is mounted so that is can move in a radially inwardly direction with respect to the drum 110 so that it can make contact for applying solution to the paper carried by the drum.

In the embodiment shown in FIG. 4, the processing solutions are as follows:

solution 130 is developer;

solutions 132, 134, 136 are stabilizers; and solution 138 is bleach/fix

This arrangement demonstrates that there is no need for the processing solutions to be arranged in a particular order dictated by the stages required for processing.

As before, paper 16 is attached to the surface of the drum 110 which rotates in the direction shown by arrow 118, and transfer of solution to the paper and drum is achieved in a similar way to that described above.

An exposing device 116 is included in the drum processor arrangement 100 shown in FIG. 4. This enables the paper to be exposed and processed in a single unit. The exposing device 116 is mounted to travel across the surface of the drum 110 in accurate alignment with the drum axle (not shown).

In operation, the paper 16 is attached to the surface of the drum 110. The paper is then exposed by the exposing device 116 traveling across the surface of the drum 110. Once the paper has been exposed, application roller 140 is brought into contact with the drum 110 and the paper 16 so that developer solution 130 is applied and development commences.

After a predetermined time necessary for development to be completed, roller 140 is retracted back into compartment 120 and roller 148 is brought into contact with the drum 110 and paper 16. Roller 148 then transfers fixing solution on to the paper 16 for the time necessary for fixing to occur.

Other rollers 142, 144, 146 from respective compartments 132, 134, 136 are also brought into and out of contact with the drum 110 and paper 16 as required until processing is completed. The exposed and processed paper is then removed from the surface of the drum 110.

In the arrangement shown in FIG. 4, cross-contamination between developer solution 130 and fixing solution 138 is substantially reduced.

Arrangements in accordance with the present invention have the following advantages:

a) The paper being processed is held firmly against the surface of the drum.

b) Tracking problems associated with paper movement through the processing apparatus are eliminated.

c) The paper can be exposed on the drum as described with reference to the embodiment of FIG. 4. However, it would also be possible to use an exposing device in the embodiment of FIG. 1.

d) The exposing device may be either optical or digital.

e) By having all the processing stages in a single unit, the overall processing machine size is substantially reduced. Throughput of material being processed is also substantially improved as there is no requirement for cross-over time.

f) The drum is rotated at high speeds and this in conjunction with the offset application roller arrangement ensures good agitation of the processing solutions at the surface being processed.

g) There is no requirement for transport rollers, chains, gears etc. to effect transportation of the paper through the various processing stages. The number of machine parts is minimized.

h) Processing solutions can be re-arranged to eliminate cross-contamination of the solutions.

i) The present invention is applicable for use in unreplenished batch mode chemistry as there is minimal cross-contamination.

It may be desirable to leave a thin layer of processing solution on the surface of the paper being processed. In this case, movement of the application rollers would be adjusted so that a gap is maintained between the application rollers and the drum.

It may be also be desirable to add thickeners to the processing solutions to prevent drainage when thicker laydowns of solutions are utilized.

Although three wash or stabilizer processes have been described above, it is envisaged that a single wash process may be provided in which a single compartment is repeatedly drained and refilled so that three wash processes can still be effected using that single compartment.

Additional rollers may be incorporated in each compartment for the removal of excess solution from the surface of the paper. Wiper blades could also be used to achieve this removal.

It is to be noted that apparatus constructed in accordance with the present invention allows processing solutions to be applied to the material being processed in any desired order. There is no need for the processing solutions to be applied in "conventional" order.

Furthermore, apparatus according to the present invention allows flexibility in that a previously applied solution can be applied again at a later stage during processing.

Parts List:

1,100 . . . arrangement
10,110 . . . processing drum
12,112 . . . tray assembly
14,18,54,118 . . . arrows
16 . . . material
20,22,24,26,28,120,122,124,126,128 . . . trays
30,32,34,36,38,130,132,134,136,138 . . . processing solution
40,42,44,46,48,140,142,144,146,148 . . . applicator roller
50 . . . region
116 . . . exposing device

I claim:

1. Photographic apparatus including at least a processing stage which comprises:

a rotating drum on which material to be processed is mounted;

a plurality of reservoirs each containing a processing solution; and applicator means for transferring processing solution from the plurality of reservoirs to the material being processed;

characterized in that the applicator means comprises a plurality of application rollers, each application roller being associated with a respective one of the reservoirs; and in that there is relative movement between each application roller and the rotating drum to effect transfer of the processing solution to the material being processed.

2. Apparatus according to claim 1, wherein the relative movement is achieved by movement of the rotating drum between a first position where there is no contact with the application rollers and a plurality of second positions where contact is made with respective ones of the application rollers.

3. Apparatus according to claim 1, wherein the relative movement is achieved by movement of each application roller between a first position where no contact is made with the rotating drum and a second position where contact is made with the rotating drum to effect the transfer of processing solution.

4. Apparatus according to claim 2, wherein the plurality of reservoirs is arranged side by side in an elongate tray which is mounted for reciprocating motion relative to the rotating drum.

5. Apparatus according to claim 4, wherein the application rollers lie in a plane which extends parallel to the direction of reciprocating motion.

6. Apparatus according to claim 5, wherein each application roller moves from the first position to the second position in a direction which is substantially perpendicular to the plane.

7. Apparatus according to claim 3, wherein the plurality of reservoirs is arranged in a multi-tank container disposed around at least a portion of the rotating drum.

8. Apparatus according to claim 7, wherein the application rollers lie on the circumference of a circle having its center on the axis about which the rotating drum rotates.

9. Apparatus according to claim 8, wherein each application roller moves from the first position to the second position along a radius of the circle.

10. Apparatus according to claim 1, further including an exposure device for exposing an image on the material prior to application of the processing solutions.

* * * * *